US008398123B1

(12) United States Patent
Sorkin

(10) Patent No.: US 8,398,123 B1
(45) Date of Patent: Mar. 19, 2013

(54) DUCT COUPLING SYSTEM

(76) Inventor: Felix L. Sorkin, Stafford, TX (US)

( * ) Notice: Subject to any disclaimer, the term of this patent is extended or adjusted under 35 U.S.C. 154(b) by 209 days.

(21) Appl. No.: 12/757,525

(22) Filed: Apr. 9, 2010

(51) Int. Cl.
*F16L 17/00* (2006.01)

(52) U.S. Cl. ..... 285/369; 285/390

(58) Field of Classification Search ..... 285/369, 285/417, 383, 390, 391, 34, 133.21, 133.3, 285/133.4, 125.1, 355
See application file for complete search history.

(56) References Cited

U.S. PATENT DOCUMENTS

| | | | | | |
|---|---|---|---|---|---|
| 191,768 | A * | 6/1877 | Matheson | 285/115 |
| 1,671,458 | A * | 5/1928 | Wilson | 403/343 |
| 1,853,411 | A * | 4/1932 | Gentry et al. | 285/342 |
| 1,999,706 | A * | 4/1935 | Spang | 285/116 |
| 2,079,692 | A * | 5/1937 | Lapointe | 403/334 |
| 2,127,284 | A * | 8/1938 | Board | 285/341 |
| 2,211,179 | A * | 8/1940 | Stone | 285/334 |
| 2,475,322 | A * | 7/1949 | Horton et al. | 285/154.2 |
| 2,574,081 | A * | 11/1951 | Abegg | 285/115 |
| 2,783,809 | A * | 3/1957 | Haines | 403/47 |
| 3,813,115 | A * | 5/1974 | French | 285/92 |
| 4,174,858 | A * | 11/1979 | Brooks | 285/7 |
| 4,603,889 | A * | 8/1986 | Welsh | 285/148.19 |
| 4,706,997 | A * | 11/1987 | Carstensen | 285/13 |
| 5,474,335 | A * | 12/1995 | Sorkin | 285/322 |
| 5,707,088 | A * | 1/1998 | Miller et al. | 285/345 |
| 5,799,703 | A * | 9/1998 | Kanao et al. | 138/121 |
| 5,842,727 | A * | 12/1998 | Shade | 285/148.19 |
| 5,887,909 | A * | 3/1999 | Tokuda | 285/148.9 |
| 5,954,373 | A * | 9/1999 | Sorkin | 285/312 |
| 6,322,110 | B1 * | 11/2001 | Banker et al. | 285/334 |
| 6,659,135 | B2 * | 12/2003 | Sorkin | 138/121 |
| 6,834,890 | B2 * | 12/2004 | Sorkin | 285/230 |
| 7,267,375 | B1 * | 9/2007 | Sorkin | 285/354 |
| 7,591,059 | B2 * | 9/2009 | MacAulay et al. | 29/421.1 |
| 7,621,103 | B1 * | 11/2009 | Sorkin | 52/843 |
| 7,695,021 | B1 * | 4/2010 | Sorkin | 285/229 |
| 8,016,326 | B1 * | 9/2011 | Sorkin | 285/261 |
| 2003/0132632 | A1 * | 7/2003 | Schoonen | 285/333 |
| 2005/0285399 | A1 * | 12/2005 | Mosing et al. | 285/391 |
| 2007/0252389 | A1 * | 11/2007 | Milici et al. | 285/369 |

* cited by examiner

*Primary Examiner* — Aaron Dunwoody
(74) *Attorney, Agent, or Firm* — Egbert Law Offices, PLLC

(57) ABSTRACT

A duct coupling system has a first duct with and end having a threads thereon, a second duct having an end with threads thereon, and a coupler having a first end threadedly engaged with the threads of the first duct and a second end threadedly engaged with the threads of the second duct. The ducts and the coupler are each integrally formed of a polymeric material. A plurality of tendons extend through the interior passageways of the ducts of the coupler.

2 Claims, 4 Drawing Sheets

DUCT COUPLING SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a duct coupler, and more particularly to a coupler for providing a water-tight joint between adjacent sections of duct used to provide a channel for multi-strand post-tensioning of concrete structures.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the formwork. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

Multi-strand tensioning is used when forming especially long post-tensioned concrete structures, or those which must carry especially heavy loads, such as elongated concrete beams for buildings, bridges, highway overpasses, etc. Multiple axially aligned strands of cable are used in order to achieve the required compressive forces for offsetting the anticipated loads. Special multi-strand anchors are utilized, with ports for the desired number of tensioning cables. Individual cables are then strung between the anchors, tensioned and locked as described above for the conventional monofilament post-tensioning system.

As with monofilament installations, it is highly desirable to protect the tensioned steel cables from corrosive elements, such as de-icing chemicals, sea water, brackish water, and even rain water which could enter through cracks or pores in the concrete and eventually cause corrosion and loss of tension of the cables. In multi-strand applications, the cables typically are protected against exposure to corrosive elements by surrounding them with a metal duct or, more recently, with a flexible duct made of an impermeable material, such as plastic. The protective duct extends between the anchors and in surrounding relationship to the bundle of tensioning cables. Flexible duct, which typically is provided in 20 to 40 foot sections, is sealed at each end to an anchor and between adjacent sections of duct to provide a water-tight channel. Grout then may be pumped into the interior of the duct in surrounding relationship to the cables to provide further protection.

Several approaches have been tried to solve the problem of quickly, inexpensively and securely sealing the joints between adjacent sections of duct used in multi-strand post-tensioned applications. However, all prior art devices have utilized a plurality of arcuate sections which must be assembled at a joint around the ends of adjacent duct sections. Wedges, compression bolts or the like then are used to compress the joined sections into sealing engagement with the duct and with each other. Such prior art devices have been cumbersome to use and have proved somewhat unreliable in their ability to exclude moisture or other corrosive elements from the interior of the ducts.

Several patents have issued relating to duct couplers. For example, U.S. Pat. No. 5,320,319, issued on Jun. 14, 1994 to K. Luthi, describes a coupling element which is fitted with chamfered flanges. The sheaths of the coupler have protrusions which are inserted into the coupling element with a tubular element which forms the end of the sheaths. A sealing ring is inserted between each of the flanges and protrusions of the sheaths. The flanges and the protrusions are held together by sloping surfaces and by a groove worked within each socket. Also, U.S. Pat. No. 5,474,335, issued on Dec. 12, 1995 to the present inventor, describes a duct coupler for joining and sealing between adjacent sections of the duct. The coupler includes a body, flexible cantilevered sections on the end of the body adapted to pass over annular protrusions on the duct and locking rings for locking the cantilevered flexible sections into position, so as to lock the coupler onto the duct.

U.S. Pat. No. 5,775,849, issued on Jul. 7, 1998 to the present inventor, describes a coupler as used for ducts in post-tension anchorage systems. This duct system includes a first duct having a plurality of corrugations extending radially outwardly therefrom, a second duct having a plurality of corrugations extending radially outwardly therefrom, and a tubular body threadedly receiving the first duct at one end and threadedly receiving the second duct at the opposite end. The tubular body has a first threaded section formed on an inner wall of the tubular body adjacent one end of the tubular body and a second threaded section formed on the inner wall of the tubular body adjacent an opposite end of the tubular body. The threaded sections are formed of a harder polymeric material than the polymeric material of the first and second ducts. The tubular body has an outer diameter which is less than the diameter of the ducts at the corrugations. The first and second threaded sections have a maximum inner diameter which is less than the outer diameter of the ducts at the end of the ducts. First and second elastomeric seals are affixed to opposite end of the tubular body and juxtaposed against a surface of a corrugation of the first and second ducts.

U.S. Pat. No. 5,954,373, issued on Sep. 21, 1999 to the present inventor, describes a different type of duct coupler apparatus. The duct coupler apparatus of this patent includes a tubular body with an interior passageway between a first open end and a second open end. A shoulder is formed within the tubular body between the open ends. A seal is connected to the shoulder so as to form a liquid-tight seal with a duct received within one of the open ends. A compression device is hingedly connected to the tubular body for urging the duct into compressive contact with the seal. The compression device has a portion extending exterior of the tubular body. The compression device includes an arm with an end hingedly connected to the tubular body and having an abutment surface adjacent the end. The arm is movable between a first position extending outwardly of an exterior of the tubular body and a second position aligned with an exterior surface of the tubular body. A latching member is connected to an opposite end of the arm and serves to affix the arm in the second position. The abutment surface of the arm serves to push a corrugation of the duct against the seal and against the shoulder so as to form a liquid-tight seal between the duct and the interior of the coupler.

U.S. Pat. No. 6,764,105, issued on Jul. 20, 2004 to the present inventor, describes a duct coupler apparatus for use with precast concrete segmental construction. This coupler has a first duct, a first coupler member extending over and around an exterior surface of the first duct and having a seat opening adjacent an end of the first duct, a second duct, a second coupler member extending over and around an exterior surface of the second duct and a seat opening adjacent to an end of the second duct, and gasket received in the seats of the first and second coupler members. An external seal is affixed to an opposite end of the first coupler member and affixed to an exterior surface of the first duct. The seats of the first and second coupler members have slots facing one another. The gasket is received within these slots.

U.S. Pat. No. 6,752,435, issued on Jun. 22, 2004 to the present inventor, describes a symmetrical coupler apparatus for use with precast concrete segmental construction. This coupler member has a first duct, a first coupler member extending over and around an exterior surface of the first duct and an end opening adjacent an end of the first duct, a second duct, a second coupler member extending over and around an exterior surface of the second duct and an end opening adjacent to an end of the second duct, and a gasket received in the ends of the first and second coupler members. The gasket serves to prevent liquid from passing between the ends of the coupler members into an interior of either of the first and second ducts. An external seal is affixed to an opposite end of the first coupler member and affixed to an exterior surface of the first duct. An internal seal is interposed in generally liquid-tight relationship between an interior surface of the second coupler member and an exterior surface of the second duct.

U.S. Pat. No. 6,834,890, issued on Dec. 28, 2004 to the present inventor, teaches a coupler apparatus for use with a tendon-receiving duct in a segmental precast concrete structure. This coupler apparatus includes a coupler body having an interior passageway for receiving the duct therein. The coupler body has a generally U-shaped channel formed at one end thereof. The coupler element has a connector element formed on interior thereof adjacent one end of the coupler body so as to allow the coupler element to receive a variety of implements for the formation of the precast concrete segment.

U.S. Pat. No. 6,874,821, issued on Apr. 5, 2005 to the present inventor, describes a coupler apparatus for use with angled post-tension cables in precast concrete segmental construction. This coupler apparatus has a first duct, a first coupler member extending over and around the first duct, a second duct, a second coupler member extending over and around the second duct and a gasket received at the ends of the first and second coupler members so as to prevent liquid from passing between the coupler members into an interior of either of the ducts. The ducts extend at a non-transverse acute angle with respect to the ends of the coupler members. Heat shrink seals are affixed to the opposite ends of the coupler member so as to secure the coupler members to the ducts in liquid-tight relationship. The ends of the coupler member have generally V-shaped grooves facing each other. The gasket is received in compressive relationship within the V-shaped grooves.

U.S. Pat. No. 7,273,238, issued on Sep. 25, 2007 to the present inventor, teaches a duct coupler apparatus with compressible seals. This apparatus is used for joining the ends of a pair of ribbed ducts together. The apparatus has a collar with an interior suitable for receiving the ends of the pair of ducts therein. A first coupler element is translatably secured adjacent a first end of the collar. A compressible seal is disposed between a surface of the first coupler element and the first end of the collar. A second coupler element is secured adjacent a second end of the collar. A second seal is disposed between a surface of the second coupler element and the second end of the collar. The coupler elements are translatable so as to compress the seal such that a surface of the seal will bear against a respective rib of the pair of ducts.

U.S. Pat. No. 7,267,375, issued on Sep. 11, 2007 to the present inventor, describes a duct coupler apparatus. This apparatus is for joining ends of a pair of ducts together in end-to-end relationship. The apparatus has a collar with a first end portion and a second end portion. A first coupler element is translatably secured to an exterior of the collar for moving the first end portion between first and second positions. A second coupler element is translatably secured to the exterior of the collar so as to move the second end portion between first and second positions. The end portions have a plurality of fingers that are movable so as to be free of the surfaces of the duct when in the first position and which contact a rib of the duct when in the second position. The collar and the coupler elements form a liquid-tight seal over the respective ends of the pair of ducts.

FIGS. 1-3 herein describe the prior art coupler apparatus similar to that disclosed in U.S. Pat. No. 7,267,375. Referring to FIG. 1, there is shown the coupler apparatus 10 in of the prior art. The coupler apparatus 10 includes a collar 12, a first coupler element 14 and a second coupler element 16. A first duct 18 is received within the interior of the collar 12 and within the interior of the first coupler element 14. A second duct 20 is received within the collar 12 and within the interior of the second coupler element 16. The collar 12 has an interior suitable for receiving the ducts 18 and 20 in end-to-end relationship and in generally longitudinal alignment. The collar 12 has first end portion 22 at one end thereof and a second end portion 24 at an opposite end thereof. Each of the end portions 22 and 24 are movable between a first position (illustrated by end portion 24) spaced away from the interior of the collar 12 and a second position (illustrated by end portion 22) which extends toward the interior of the collar 12. The first coupler element 14 is translatably secured to the exterior of the collar 12. The first coupler element 14 is translatable so as to move the first end portion 22 between the first and second positions. The second coupler element 16 is also translatably secured to the exterior of the collar 12. The second coupler element 16 is translatable so as to move the second end portion 24 between the first and second positions.

As can be seen in FIG. 1, the first duct 18 has a plurality of ribs 26 formed thereon. Longitudinal channels 28 extend between the ribs 26 and allow liquid and grout therein to communicate between the ribs 26. Longitudinal channels 28 have an outer edge which is flush with the outer diameter of the respective ribs 26. The first duct 18 has an outer wall which extends between the ribs 26 and defines the interior of the duct 18. The second duct 20 similarly has a plurality of ribs 32, longitudinal channels 34 and wall 36. The first duct 18 is identical to the second duct 20. In normal use, the ducts 18 and 20 will receive tendons therein and allow a grout material to fill the interior thereof. The respective channels 28 and 34 allow grout to fill the interior of the respective ducts 18 and 20 and to flow into the ribs 26 and 32, respectively.

As can be seen, the first end portion 22 has a plurality of finger elements 38, 40, 42, 44 and 46 extending outwardly therefrom. In FIG. 1, for the purposes of illustration, the finger element 38 is illustrated in its second position which serves to lock the first duct 18 in its proper position. The finger element 22 has a lower surface 48 which will reside in surface-to-surface relationship with the wall 30 of duct 18. An extension element 50 extends outwardly as a tip from the finger element 38 so as to reside over the outer surface of the rib 26. An inclined surface extends between the tip 50 and the surface 48 so as to reside against the slanted surface of the rib 26. The remaining finger elements 40, 42, 44 and 46 are illustrated in the first position extending away from the surface of the duct. In normal use, the finger elements 38, 40, 42, 44 and 46 will move cooperatively relative to the translation of the first coupler element 14 on the collar 12.

The collar 12 has a plurality of finger elements 52, 54, 58, and 60 extending outwardly from an opposite end thereof of finger elements 22. Each of the finger elements 52, 54, 58, and 60 is illustrated in the first position spaced away from the exterior surface of the duct 20. The coupler element 16 is translatable relative to the collar 12 so as to move the finger elements 52, 54, 58, and 60 to the second position.

In FIG. 1, it can be seen that there is an indented portion 62 formed in the collar 12 generally between the ends of the ducts 18 and 20. The indented surface 62 will have an interior surface aligned with interior surface of the respective ducts 18 and 20.

The collar 14 is translatable about one end of the collar 12. The translating motion in the preferred embodiment of the present invention is established by a threaded relationship between the exterior surface of the collar 12 and the interior surface of the coupler 14. In other embodiments of the present invention, the coupler element 14 is translatable by slidable or ratcheting motion. Suitable hinging mechanisms or other cantilever or lever actions can be incorporated within the apparatus 10 so as to facilitate proper translatable motion of the coupler elements 14 and 16 on the collar 12. Coupler element 16 will have a configuration similar to that of coupler element 14 and will translate in the same manner as coupler element 14. Each of the coupler elements 14 and 16 has a plurality of ribs 64 formed on an exterior surface thereof. Each of the plurality of ribs 64 extends longitudinally for at least a portion of the length of the respective coupler elements 14 and 16. The plurality of ribs are radially spaced from each other around the diameter of the respective coupler elements 14 and 16. Ribs 64 facilitate the ability of a worker to grasp the exterior surface of the coupler elements 14 and 16 and to provide the necessary translatable motion with respect to the movement of the coupler elements 14 and 16 onto the respective end portions 22 and 24.

FIG. 2 illustrates the collar 12 as having the end portions 22 and 24 in the first position away from the respective ducts 18 and 20. In FIG. 2, the collar 12 is illustrated as having the indented portion 62 formed between the respective ends 66 and 68 of ducts 18 and 20. The inward surface of the indented portion 62 is in coplanar alignment with the inner surface 70 of duct 18 and inner surface 72 of duct 20. The collar 62 has an annular seal 74 extending around the interior of the collar 12. A second annular seal 76 is also affixed to the collar 12 and extends around the interior of the collar 12. The annular seals 74 and 76 can be formed of a suitable elastomeric material such that the seal 74 establishes a liquid-tight relationship with the rib 26 of duct 18. The annular seal 76 will establish a liquid-tight seal with the rib 32 of duct 20. It can be seen that the collar 12 has an inner surface which will generally abut the tops of the respective shoulders 26 and 32 of the ducts 18 and 20. As such, the ducts 18 and 20 can be easily installed within the interior of the collar 12 by slidably inserting the ends 66 and 68 of ducts 18 and 20 into opposite ends of the collar 62.

In FIG. 2, it can be seen that the collar 12 has a threaded exterior surface 78. The collar 12 also has another threaded exterior surface 80 formed thereon. The end portion 22 is integrally formed with the collar 12 at one end of the collar 12. The second end position 24 is also integrally formed with the collar 12 at the opposite end of the collar 12. The threaded portions 78 and 80 are respectively interposed between the indented portion 62 and the end portions 22 and 24. The end portion 22 has a shoulder 82 formed thereon. The end portion 24 also has a shoulder 84 formed thereon. Underlying surface 48 extends from shoulder 82 outwardly therefrom. Another underlying surface 86 is formed on the end portion 24 and extends outwardly from the shoulder 84. End surfaces 48 and 86 will extend generally upwardly at an acute angle with respect to a longitudinal axis of the collar 12. In FIG. 2, the first position of the end portions 22 and 24 is particularly illustrated. As such, the shoulders 82 and 84, along with the surfaces 48 and 86, will be generally spaced away from the respective ducts 18 and 20 so as to allow for the free insertion of the ends 66 and 68 of ducts 18 and 20 into the collar 12.

The first coupler element 14 is illustrated as having interior threads 88 engaged with the exterior threads 78 of the collar 12. The first coupler element 14 has an abutment end 90 extending into contact with a surface of the end portion. Similarly, the second coupler element 16 has an interior threaded section 92 threadedly engaged with the exterior threads 80 of the collar 12. An abutment end 94 is formed on the coupler element 16 so as to reside against the surface of the end portion 24.

FIG. 3 illustrates how the coupler elements 14 and 16 translate so as to move the end portions 22 and 24 into their second or locking positions. In normal use, the coupler elements 14 and 16 will be rotated so that the interior threads 88 will translate along the exterior threads 78 at one end of the collar 12. The second coupler element 16 will similarly have its interior threads 92 rotate with respect to the exterior threads 80. This causes the abutment end 90 of coupler element 14 to urge against the surface of the end portion 22 and to move the end portion 22 downwardly. As a result, the shoulder 82 will reside in contact (illustrated in broken line fashion) against a surface of rib 26. The second coupler element 16 will work in a similar manner so that the shoulder 84 will reside in contact against a surface of the rib 32. In this locked position, it will be impossible to pull the first duct 18 away from the second duct 20. A secure seal is formed between the interior surfaces of the collar 12 and the exterior surfaces of the ducts 18 and 20. The annular seal 74 and 76 will further provide a strong liquid-tight seal against the outer surfaces of the respective ducts 18 and 20.

It has been found with the prior art coupler apparatus illustrated in FIGS. 1-3 that it is often somewhat complicated to properly install the apparatus. In certain circumstances, the installation can be somewhat time consuming. As such, it has been found that there is a need to provide a coupler apparatus for ducts which allows workman at the construction site to easily connect the ends of the ducts through a use of a coupler. The coupler should be of a type that is suitable for effectively engaging the ends of the ducts in a liquid-tight manner. The coupler apparatus should have a minimum number of moving parts so as to effectively create the necessary seal while, at the same time, avoids complexities in the actual manufacturing injection molding of such a coupler apparatus.

It is an object of the present invention to provide a duct coupling system that allows the ends of tendon-receiving ducts to be joined in a proper end-to-end relationship.

It is another object the present invention to provide a duct coupling system that effectively establishes a liquid-tight seal between the respective coupled ducts.

It is another object of the present invention to provide a duct coupling system which allows the coupler to be formed through an injection molding process.

It is still another object of the present invention to provide a duct coupling system which allows the ducts to be effectively coupled in a minimal amount of time with a minimum complexity.

These and other objects and advantages of the present invention will become apparent from a reading of the attached specification and appended claims.

BRIEF SUMMARY OF THE INVENTION

The present invention is a duct coupling system that comprises a first duct, a second duct, and a coupler that joins the first duct to the second duct. The first duct has an interior passageway at a first end. The first end has threads thereon. The interior passageway opens at the first end of the first duct. The second duct also has an interior passageway at a first end. The interior passageway of the second duct opens at the first end of the second duct. The first end of the second duct has threads thereon. The coupler is a generally tubular body with a first end and a second end and an interior passageway extending therebetween. The first end of the tubular body is threadedly engaged with the threads of the first end of the first duct. The second end of the coupler is threadedly engaged with the threads at the first end of the second duct.

The interior passageway of the first duct and the interior passageway of the second duct and the interior passageway of the coupler are axially aligned.

The thread of the duct has a unique configuration. The thread of the first end of the first duct has a narrow width portion and a wide width portion. This thread extends radially outwardly of the first duct for a lesser distance at the narrow width portion than a distance at the wide width portion. The narrow width portion of this thread is spaced from the narrow width portion of an adjacent thread. The wide width portion is offset by approximately 90° from the narrow width portion.

Each of the first and second ducts has a ridge extending circumferentially therearound adjacent the first end thereof. The coupler has a first lip extending longitudinally outwardly therefrom so as to overlie the ridge of the first duct. The coupler having a second lip extending longitudinally outwardly therefrom so as to overlie the ridge of the second duct. The body of the coupler has a first ring seal juxtaposed between an inner surface of the body and a surface of the ridge of the first duct. The body of the coupler also has a second ring seal juxtaposed between another inner surface of the body and surface of the ridge of the second duct. The body of the coupler has a radially indented area extending circumferentially therearound between the first and second ends of the coupler. This radially indented area is positioned between the first end of the first duct and the first end of the second duct. The first end of the body of the coupler has a square threads extending inwardly therefrom and engaged with the threads at the first end of the first duct. The second end of the body of the coupler has square threads extending inwardly therefrom and engaged with the threads at the first end of the second duct. The thread at the first end of the first duct has an end and a portion circumferentially spaced from this end of the thread. The end of the thread extends radially outwardly of the first duct for a lesser distance than a distance that the portion extends outwardly of the first duct. The first end of the body of the coupler is slidable over the ends of the thread. The coupler is rotatable relative to the first duct so that the threads at the first end of the body of the coupler engaged with the portion of the threads at the first end of the first duct.

In the present invention, each of the first duct and the second duct and the coupler are integrally formed of a polymeric material. A plurality of tendons extend through the interior passageways of the first duct, the second duct, and the coupler.

The present invention is also a duct coupler that includes a generally tubular body having a first end and a second end with interior passageway extending therebetween. The first end and the second end are interiorly threaded. The body is formed of a polymeric material. The threads at the first end and the threads at the second end of the body are square threads. The body has an outer surface with a first lip extending longitudinally outwardly at the first end and a second lip extending outwardly at the second end. A first ring seal is affixed against an inner surface of the body adjacent the first lip. A second ring seal affixed against an inner surface of the body adjacent the second lip. The body has a radially indented area around a circumference thereof in an area between said first and second ends.

DETAILED DESCRIPTION OF THE INVENTION

Figure 1:
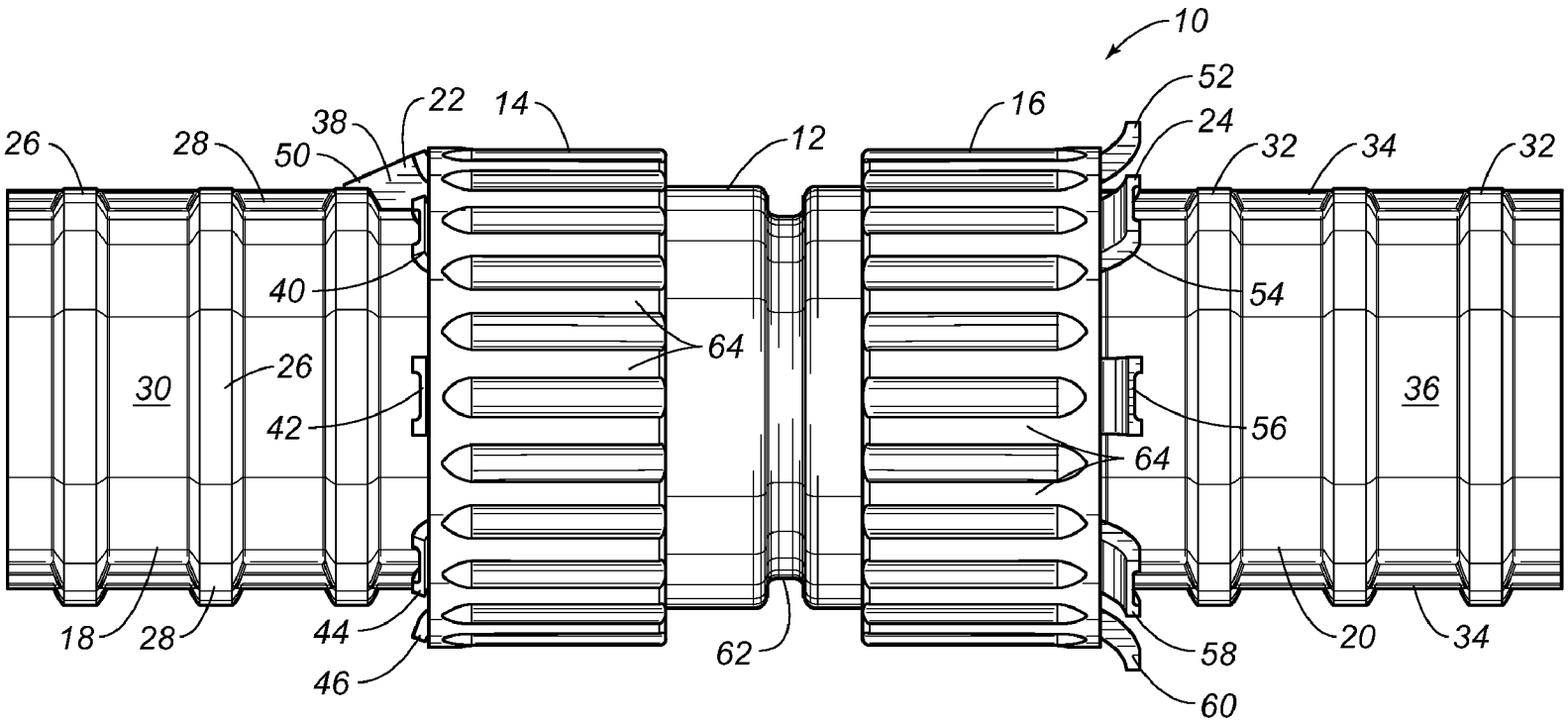
FIG. 1 Prior Art
FIG. 1 is a side elevational view of a prior art duct coupler.
Figure 2:
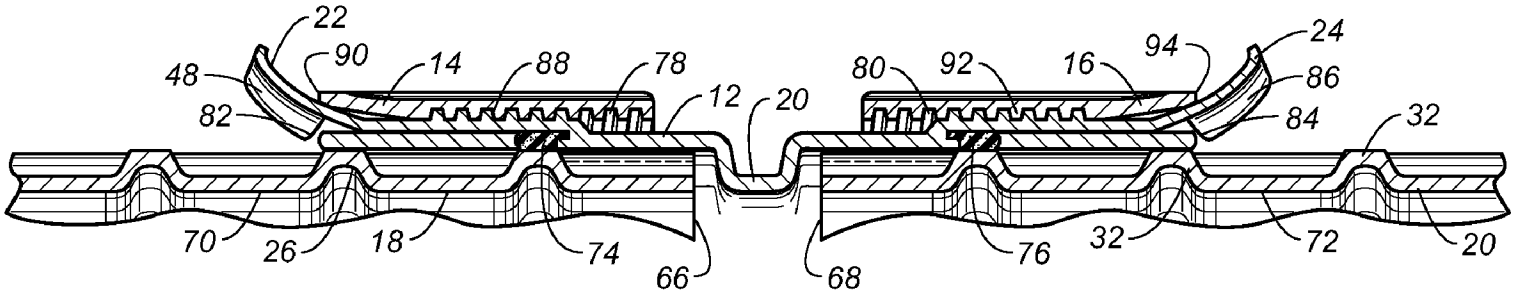
FIG. 2 Prior Art
FIG. 2 is a cross-sectional view showing the end portions of the collar of the coupler apparatus of the prior art in a first position.
Figure 3:
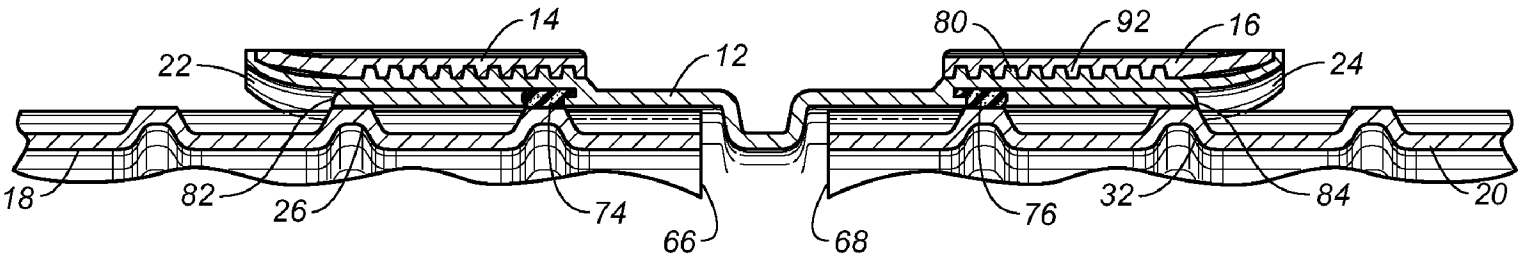
FIG. 3 Prior Art
FIG. 3 is a cross-sectional view showing the end portions of the collar of the coupler of the prior art in the second locked position.
Figure 4:
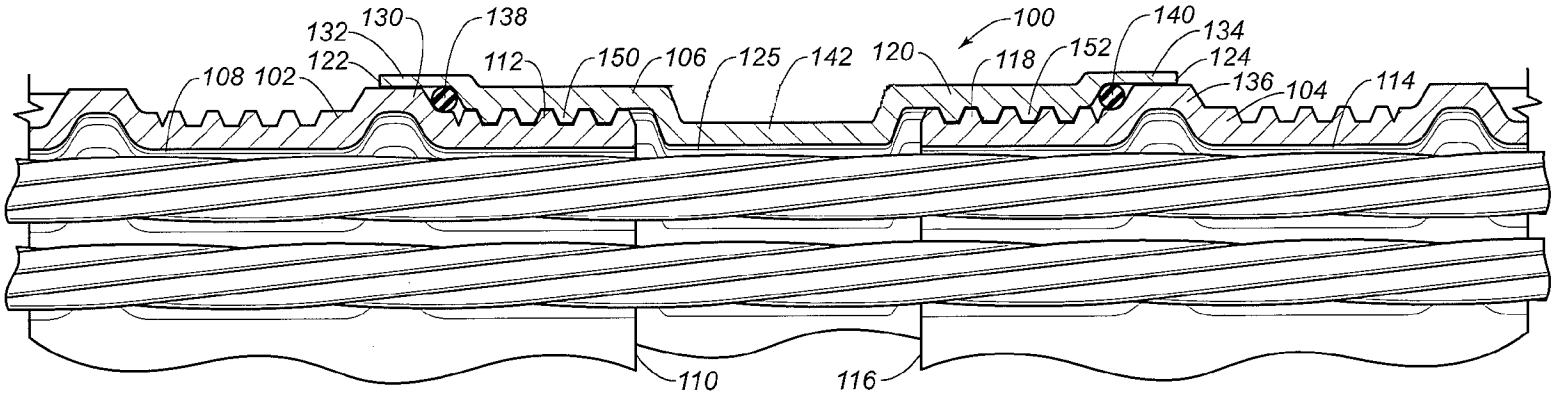
FIG. 4 is a cross-sectional view showing the duct coupling system in accordance with the preferred embodiment of the present invention.

Referring to FIG. 4, there is a shown the duct coupling system 100 in accordance the preferred embodiment of the present invention. The duct coupling system 100 includes a first duct 102, a second duct 104 and a coupler 106. Coupler 106 joins the ducts 102 and 104 in a liquid-tight relationship.

The first duct has an interior passageway 108 and a first end 110. The interior passageway 108 opens at the first end 110. The first end 110 has threads 112 formed thereon. The second duct 104 has an interior passageway 114 and a first end 116. The interior passageway 114 of the second duct 104 opens at the first end 116. The first end 116 of the second duct 104 has threads 118 formed thereon.

The coupler 106 has a generally tubular body 120. The tubular body 120 has a first end 122 and a second end 124. The coupler 106 also has an interior passageway 125 extending between the first end 122 an the second end 124. It can be seen that the first end 122 of the body 120 is threadedly engaged with the threads 112 at the first end 110 of the first duct 102. The second end 124 of the coupler 106 is threadedly engaged with the threads 118 at the first end 116 of the second duct 104.

The interior passageway 108 of the first duct 102 and the interior passageway 114 of the second duct 104 and the interior passageway 125 of the coupler 106 are longitudinally axially aligned.

In FIG. 4, it can be seen that the first duct 102 has a ridge 130 extending circumferentially therearound adjacent to the first end 110 thereof. The coupler 106 has a first lip 132 extending longitudinally outwardly therefrom so as to overlie the ridge 130 of the first duct 102. The coupler 106 also has a second lip 134 extending longitudinally outwardly therefrom so as to overlie the ridge 136 of the second duct 104. It can be seen that there is a first elastomeric ring seal 138 juxtaposed between an inner surface of the body 120 of the coupler 106 and a surface of the ridge 130 of the first duct 102. A second elastomeric ring seal 140 is juxtaposed between another inner surface of the body 120 of the coupler 106 and a surface of the ridge 136 of the second duct 104.

The coupler 106 has a radially indented area 142 extending circumferentially therearound between the first end 122 and the second end 124 of the coupler 106. This radially indented area 142 is positioned between the first end 110 of the first duct 102 and the first end 116 of the second duct 104.

In FIG. 4, it can be seen that the first end 122 of the body 120 has square threads 150 extending inwardly therefrom and engaged with the threads 112 at the first end 110 of the first duct 102. The second end 124 of the body 120 of coupler 106 also has square threads 152 that are engaged with the threads 118 at the first end 116 of the second duct 104.

Figure 5:
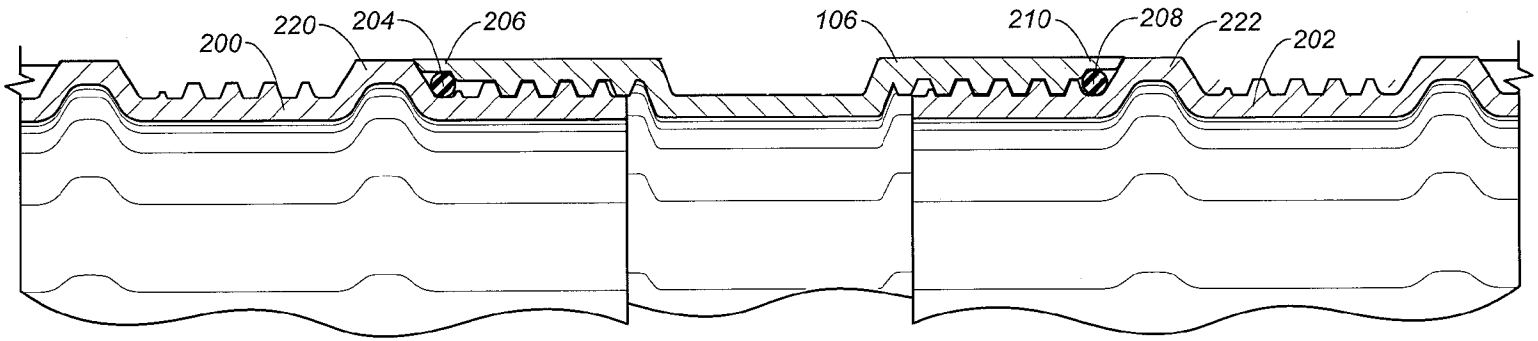
FIG. 5 is a cross-sectional view showing the duct coupling system of the present invention with the coupler rotated 90° with respect to the duct.

FIG. 5 shows another form of the present invention in which the coupler 106 is illustrated as being located in another position with respect to the threads of the respective ducts 200 and 202. It can be seen in FIG. 5 that the first elastomeric ring seal 204 that juxtaposed against an inner surface of the lip 206 at the end of coupler 106 and an outer surface of the first duct 200. There is also another elastomeric ring seal 208 that is juxtaposed in liquid-tight relationship between the end 210 of the coupler 106 and an outer surface of the duct 202. In this embodiment, the lips at the end of the coupler 106 do not overlie the ridge 220 of the first duct 200 and the ridge 222 of the second duct 202.

Figure 6:
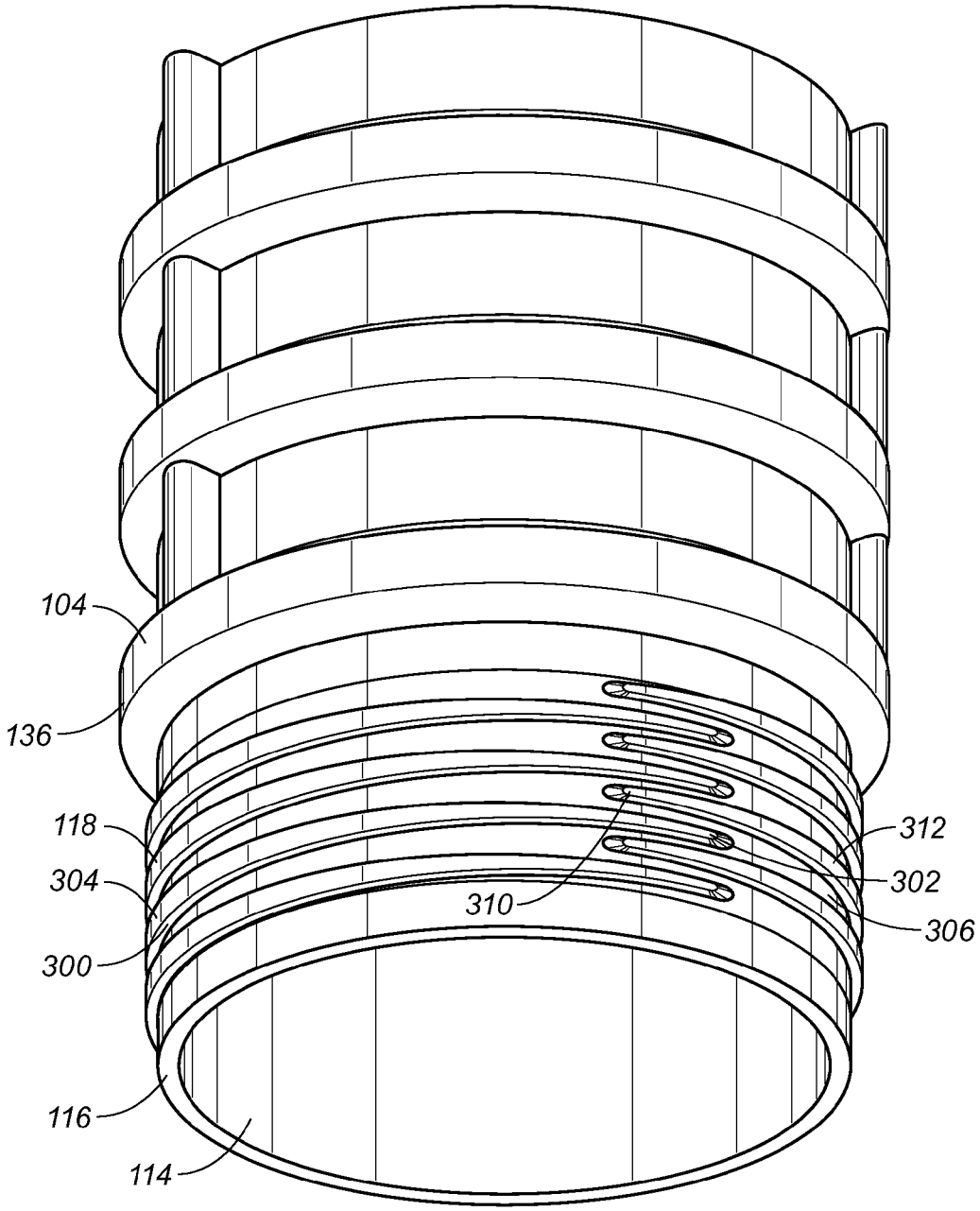
FIG. 6 is a upper perspective view of an end of either the first duct and a second duct as used with the coupler apparatus of the present invention.

FIG. 6 shows the ends of the respective ducts. In particular, duct 104 is particularly illustrated in FIG. 6. The unique configuration of the threads 118 adjacent to the end 116 of the duct 104 are particularly illustrated. The duct 104 is illustrated as having interior passageway 114 opening at the end 116 and extending therethrough. The duct 104 is also illustrated as having the ridge 136 extending circumferentially therearound and forming a raised surface with respect the to threads 118.

In particular, in FIG. 6, it can be seen that there is illustrated a single thread 300. The threads 300 includes a narrow width portion 302 and a wide width portion 304. The narrow width portion 302 is of set by approximately 90° from the wide width portion 304. In the preferred embodiment of the present invention, the narrow width portion 302 extends outwardly of the surface 306 of the duct 104 for a distance less than the distance that the wide width portion 304 extends outwardly from surface 306. The narrow width portion 302 is in spaced relationship to another narrow width portion 310 of an adjacent thread. The narrow width portion 310 of the adjacent thread 312 extends pass the end of the thread 300. The alignment of the various narrow width portions of the various thread 300 will serve to allow the teeth of the duct coupler to be slidably positioned thereover. To install the duct, it is only necessary to push the threaded portion of the coupler over the narrow width portion so that the end of the coupler abuts the ridge 136. The coupler can then be rotated upwardly or downwardly such that the threads become wedged between the wide width portion 304 of the various threads 300. As such, a 90° rotation of the coupler in one direction or another will cause the coupler to be installed effectively in a liquid-tight sealing manner. As such, installation in the coupler can be accomplished in a very efficient and effective manner. If it is desired to remove the coupler for any reason, it is only necessary to rotate the coupler backward by 90° so that the threads can slide over the narrow width portions of the duct 104. A similar operation can be used so as to install the coupler over the respective threads of the first duct 102.

In the present invention, the coupler is able to establish a liquid-tight seal in a fast and efficient manner. Additionally, the coupler can be formed through an injection molding process. It is only necessary to form the threads on the inner surface of the coupler. The lips of the coupler will extend outwardly so as to effectively center the coupler with respect to ridges formed on the ducts. As such, a proper alignment of the couplers with the duct is effectively achieved. The liquid-tight sealing relationship is established by virtue of the rotation of the coupler with respect to the ducts.

The foregoing description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A duct coupler comprising:

a generally tubular body having a first end and a second end, said generally tubular body having a circular cross-section, said body having an interior passageway extending from said first end to said second end, said first end having a plurality of threads formed on an interior wall and extending inwardly from said first end, said second end having a plurality of threads formed on the interior wall of said tubular body and extending inwardly formed said second end, said tubular body having an outer surface, said outer surface being radially indented around a circumference thereof centrally between said first end and said second end, the threads at said first end and the threads at said second end of said body being square threads, said body having an outer surface with a first lip extending longitudinally outwardly of said first end and a second lip extending longitudinally outwardly at said second end, said tubular body having an outer diameter at said second end of said body, said first lip having a circular cross-section with an outer diameter greater than said outer diameter at said first end of said body, said second lip having a circular cross-section with an outer diameter greater than said outer diameter at said second end of said body.

2. The duct coupler of claim 1, further comprising:

a first ring seal affixed against an inner surface of said body adjacent said first lip; and a second ring seal affixed against an inner surface of said body adjacent said second lip.

* * * * *